US008118174B2

(12) United States Patent
Gnann et al.

(10) Patent No.: US 8,118,174 B2
(45) Date of Patent: Feb. 21, 2012

(54) DEVICE FOR DELIVERING BULK MATERIAL STORED IN A SUPPLY CONTAINER

(75) Inventors: Kurt Gnann, Biberach (DE); Sandra Amann, Laupheim (DE); Harald Mauz, Ehingen (DE); Wolfgang Krahl, Laupheim (DE)

(73) Assignee: Uhlmann Pac—Systeme GmbH & Co. KG, Laupheim (DE)

( * ) Notice: Subject to any disclaimer, the term of this patent is extended or adjusted under 35 U.S.C. 154(b) by 327 days.

(21) Appl. No.: 12/422,759

(22) Filed: Apr. 13, 2009

(65) Prior Publication Data

US 2009/0255859 A1 Oct. 15, 2009

(30) Foreign Application Priority Data

Apr. 14, 2008 (EP) ..... 08007276

(51) Int. Cl.
*B07C 5/36* (2006.01)

(52) U.S. Cl. ..... 209/684; 209/606; 209/682

(58) Field of Classification Search ..... 209/682, 209/684, 660, 910; 53/539, 475; 221/10
See application file for complete search history.

(56) References Cited

U.S. PATENT DOCUMENTS

| | | | | |
|---|---|---|---|---|
| 3,011,678 | A * | 12/1961 | McClosky et al. | 221/10 |
| 3,705,475 | A * | 12/1972 | Riley | 53/475 |
| 4,693,057 | A | 9/1987 | Rittinger et al. | |
| 5,044,143 | A * | 9/1991 | Ako et al. | 53/448 |
| 7,328,557 | B2 * | 2/2008 | Gertitschke et al. | 53/539 |
| 2009/0255859 | A1 * | 10/2009 | Gnann et al. | 209/682 |

FOREIGN PATENT DOCUMENTS

| | | |
|---|---|---|
| DE | 1 949 037 | 4/1971 |
| DE | 10 2005 049 882 | 2/2007 |
| EP | 0 224 017 | 6/1987 |
| EP | 1 588 944 | 10/2005 |
| EP | 1 803 646 | 7/2007 |

* cited by examiner

*Primary Examiner* — Terrell Matthews
(74) *Attorney, Agent, or Firm* — Cozen O'Connor

(57) ABSTRACT

A device for delivering bulk material consisting of individual products has a supply container for storing the bulk material of individual products, the supply container having a product outlet. A perforated plate is arranged downstream of the product outlet of the supply container on a base stand. The perforated plate serves to receive the individual products from the product outlet and to move them further in a transport direction while removing broken products and dust. A bulk material leveler formed as a leveler strip rotatable around a pivot axis is arranged downstream of the product outlet above the perforated plate.

9 Claims, 15 Drawing Sheets

DEVICE FOR DELIVERING BULK MATERIAL STORED IN A SUPPLY CONTAINER

BACKGROUND OF THE INVENTION

1. Field of the Invention

The invention pertains to a device for delivering bulk material consisting of individual products stored in a supply container to a transfer unit, which transfers the individual products into the pockets of a continuously or cyclically moving web of sheeting. The device is provided with a perforated plate arranged downstream of the product outlet of the supply container on a base stand.

2. Description of the Related Art

These types of devices are used in particular in the work station of thermoforming machines, in which the individual products, which are made available as bulk material in a supply container, are subjected to further processing so that they can be loaded into the pockets in the web of sheeting. For this purpose, the individual products are delivered from the supply container through the product outlet onto the perforated plate.

SUMMARY OF THE INVENTION

It is an object of the present invention to provide a device of the type indicated above with which the operation of the transfer unit is simplified.

According to an aspect of the invention, the device for delivering bulk material consisting of individual products comprises: a supply container for storing the bulk material of individual products, the supply container having a product outlet; at least one perforated plate arranged downstream of the product outlet of the supply container on a base stand, the at least one perforated plate serving to receive the individual products from the product outlet and to move them further in a transport direction while removing broken products and dust; and a bulk material leveler formed as a leveler strip rotatable around a pivot axis, the bulk material leveler being arranged downstream of the product outlet above the perforated plate.

This bulk material leveler offers the double advantage that, first, the individual products emerging from the product outlet of the supply container are converted from a product column into a product carpet, and, second, that the fanning-out of the product carpet over the entire width of the perforated plate is promoted, so that the area provided by the perforated plate can be used effectively for the separation of dust and breakage.

Because very strict requirements on cleanliness are imposed in the pharmaceutical area in particular, it is also necessary that it be possible to clean the device and especially the perforated plate and the bulk material leveler whenever there is a product changeover. It is therefore advisable for the bulk material leveler to be connected detachably to the base stand.

So that the individual products leaving the product column and entering the product carpet can be treated gently, it is favorable for an elastic lip to be arranged on the free end of the bulk material leveler facing the perforated plate.

If the rotational position of the bulk material leveler can be held by means of a positioning element, it is easy to adjust the rotational position of the bulk material leveler as a function of the size of the individual products, especially their height.

To arrive at the simplest possible design, the positioning element is formed by a clamping screw with a T-handle, which can be inserted into a screw receiving groove which is open in the upward direction.

So that the distance between the elastic lip and the perforated plate can be adjusted with sensitivity, an adjusting lever is mounted on the clamping screw.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below on the basis of an exemplary embodiment, which is illustrated in the drawings.

DETAILED DESCRIPTION OF THE PRESENTLY PREFERRED EMBODIMENTS

Thermoforming machines are used especially in the pharmaceutical industry to package individual products such as tablets, dragees, pills, or the like in blister packs, for which purpose thermoplastic sheet is pulled in the form of a web of sheeting from a supply roll in the thermoforming machine and sent to a heating station, in which the thermoplastic sheet is heated to the preforming temperature, and then to a forming station, in which the pockets of the blister packs are formed. In order to facilitate the filling of the pockets in the web of sheeting, the device according to the invention serves as a connecting element between a product supply and a transfer unit, which transfers the individual products into the pockets in the web of sheeting.

Figure 1:
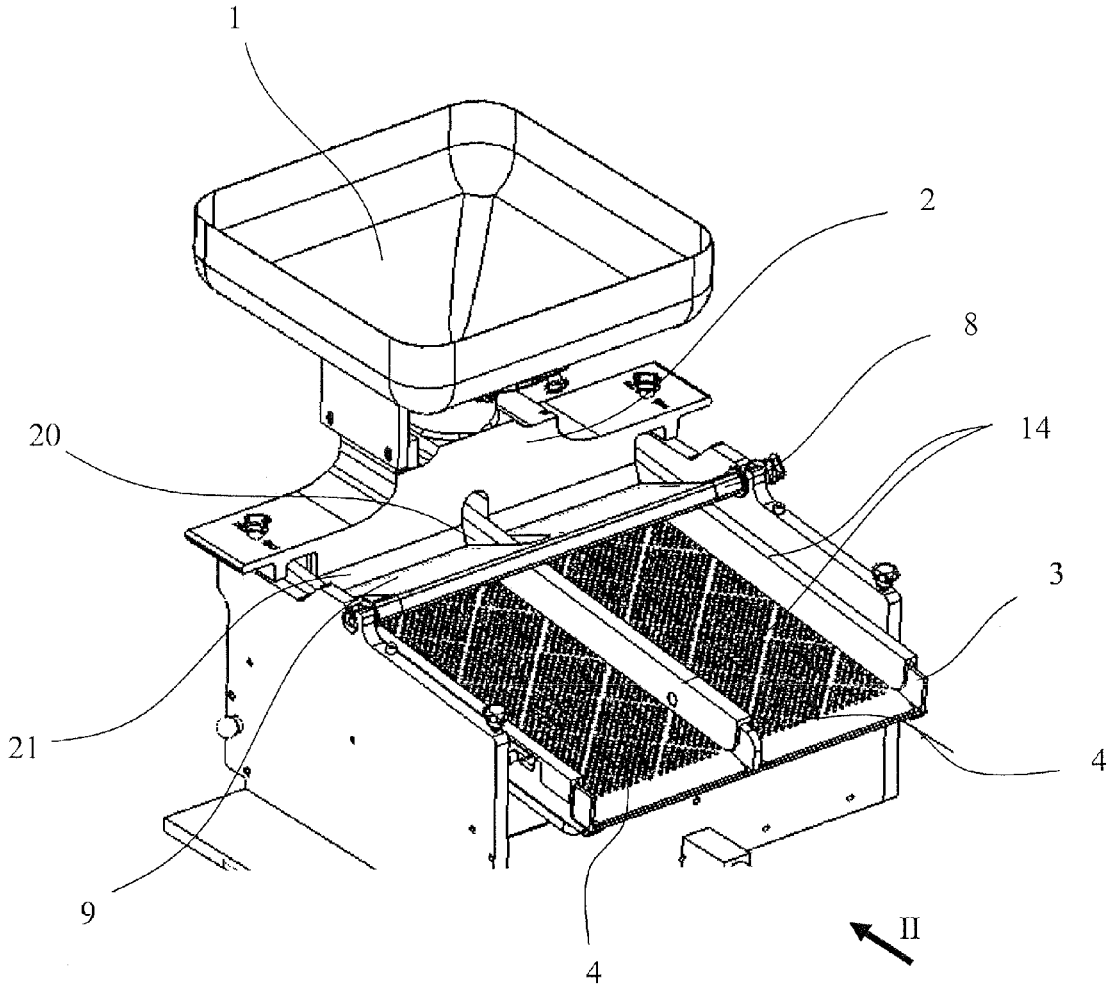
FIG. 1 is a perspective view of one embodiment of the device according to the invention.
Figure 2:
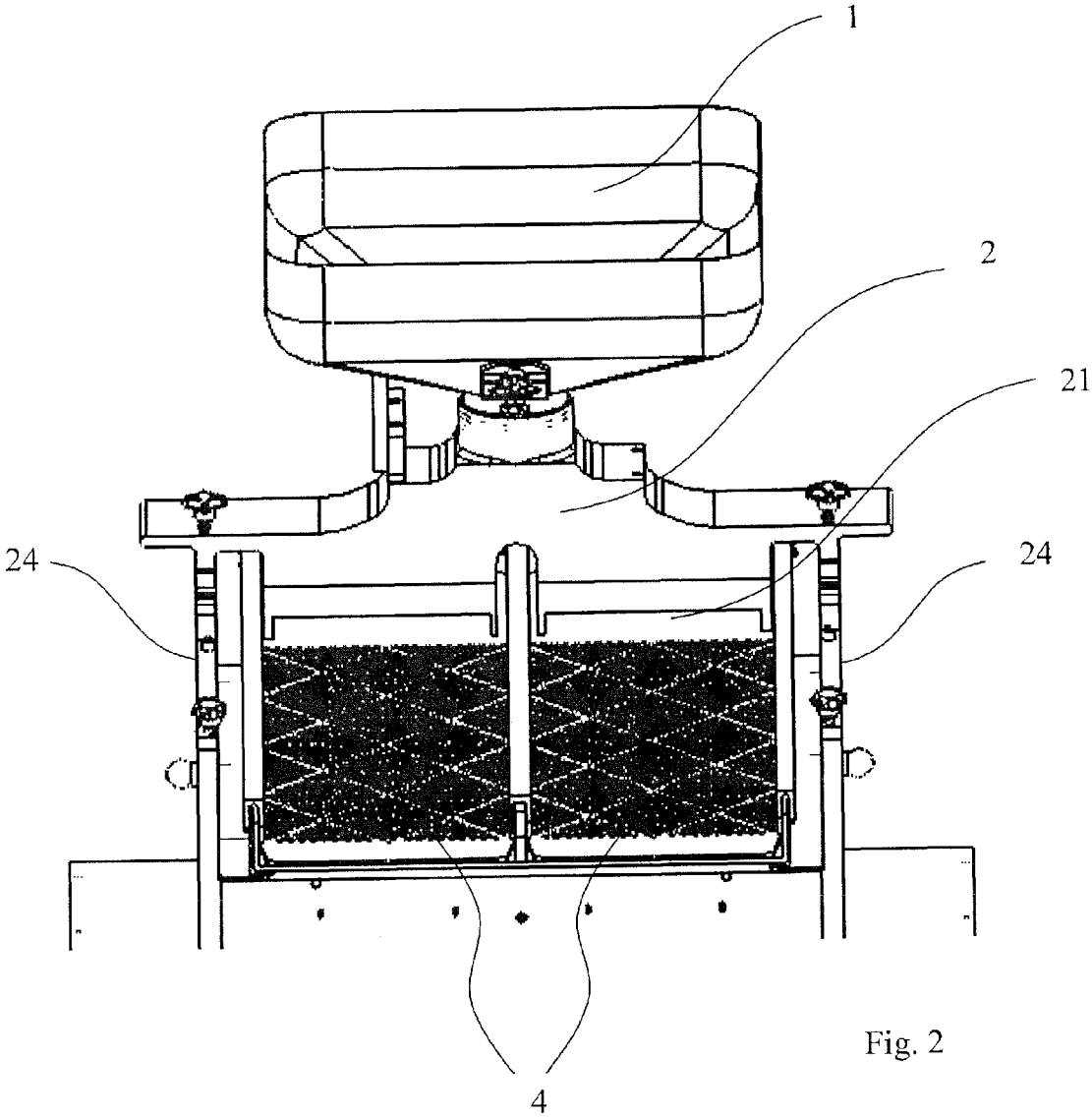
FIG. 2 is a view in the direction of the arrow II in FIG. 1.

FIGS. 1 and 2 show the device, which comprises for this purpose not only the supply container 1 with its product outlet 2 but also a perforated plate 4, which is mounted detachably and replaceably downstream from the product outlet 2, in a plate holder 3 of a base stand 24. In the exemplary embodiment shown here, several of these perforated plates 4 are present, specifically two of them arranged in a row perpendicular to the transport direction of the individual products, so that as a result a large effective width of the device is obtained by very simple means.

Figure 7A:
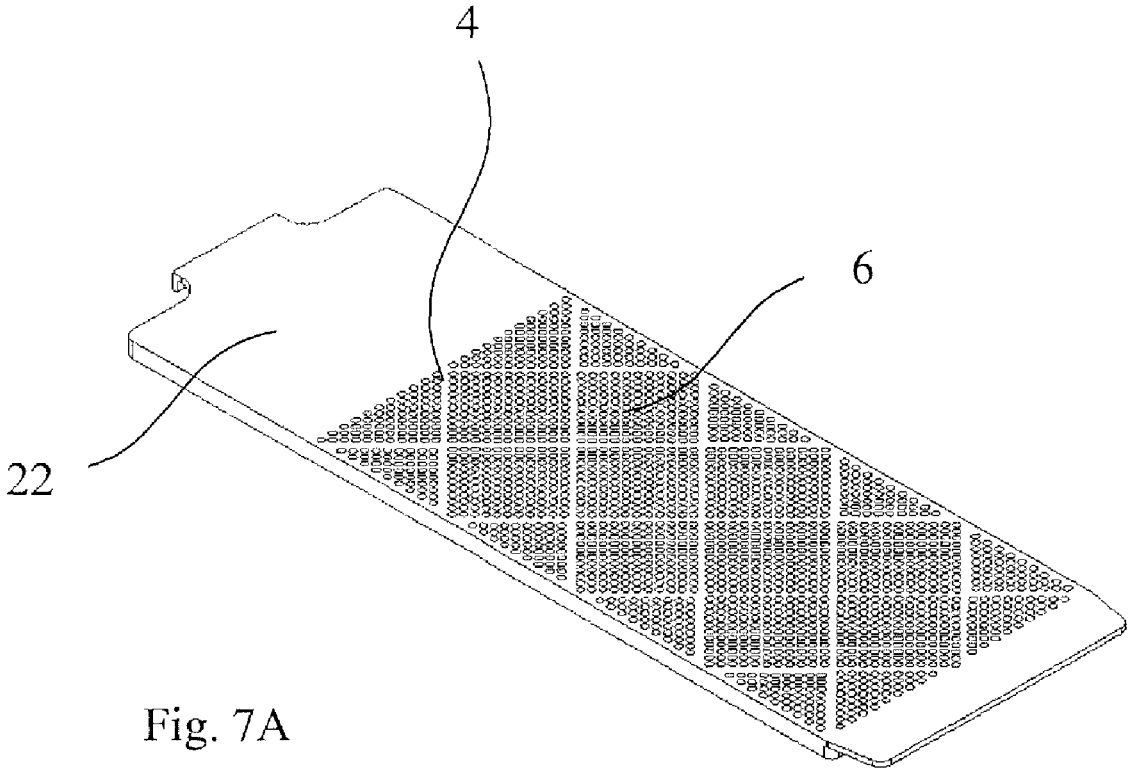
FIG. 7*a* is a perspective view of the perforated plate from above.
Figure 7B:
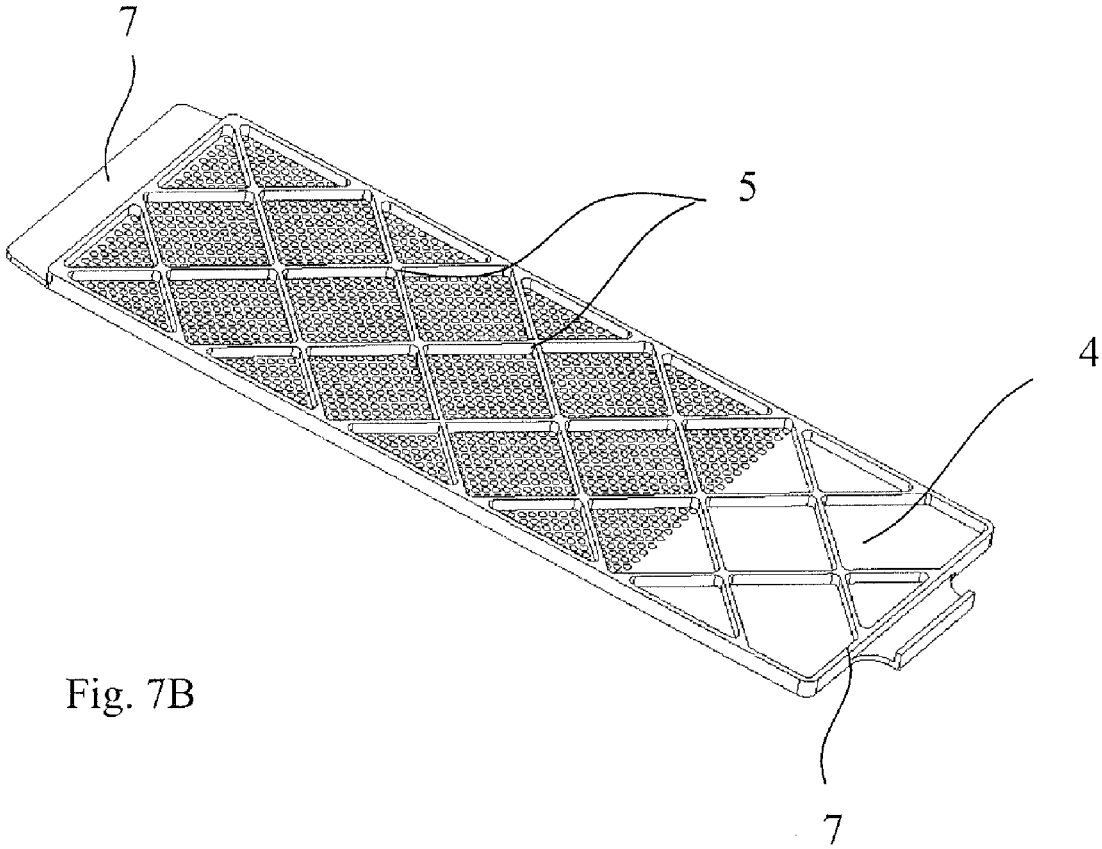
FIG. 7*b* is a perspective view of the perforated plate from below.

Each perforated plate 4 comprises a plurality of holes adapted to the diameter and the shape of the individual products. The holes hold back intact individual products on the surface of the perforated plate 4 but allow breakage and dust to pass through. On the side of the perforated plates 4 facing away from the individual products are stiffening ribs 5 (FIG. 7*b*), which slant inward from the opposing lateral edges and divide the rectangular perforated plate 4 into separate areas 6, wherein the holes are formed only in the areas 6 of the perforated plate 4 between the stiffening ribs 5. Support surfaces 7 without stiffening ribs 5 may be provided at the leading and trailing ends (with respect to the transport direction) of the perforated plates 4. These support surfaces allow the perforated plate 4 to lie in a defined position in the base stand 24 and also make it easier to connect the vibratory drive provided to convey the products from the product outlet 2 to the transfer unit (not shown). Because the plurality of perforated plates 4 can be arranged in a single base stand 24, one vibratory drive is usually sufficient, which offers a corresponding cost advantage. In addition, to support the action of the vibratory drive, it is also possible, of course, for the base stand 24 to slant downward in the transport direction so as to take advantage of the force of gravity.

The surface area directly under the product outlet 2 cannot be used to separate breakage, i.e., it should not have any holes in it, because the individual products lying on the perforated plate 4 would be pressed onto the perforated plate 4 and against the edges of the holes by the product column lying on top of them, and the vibratory movements of the perforated plate 4 could thus damage the individual products.

Figure 8:
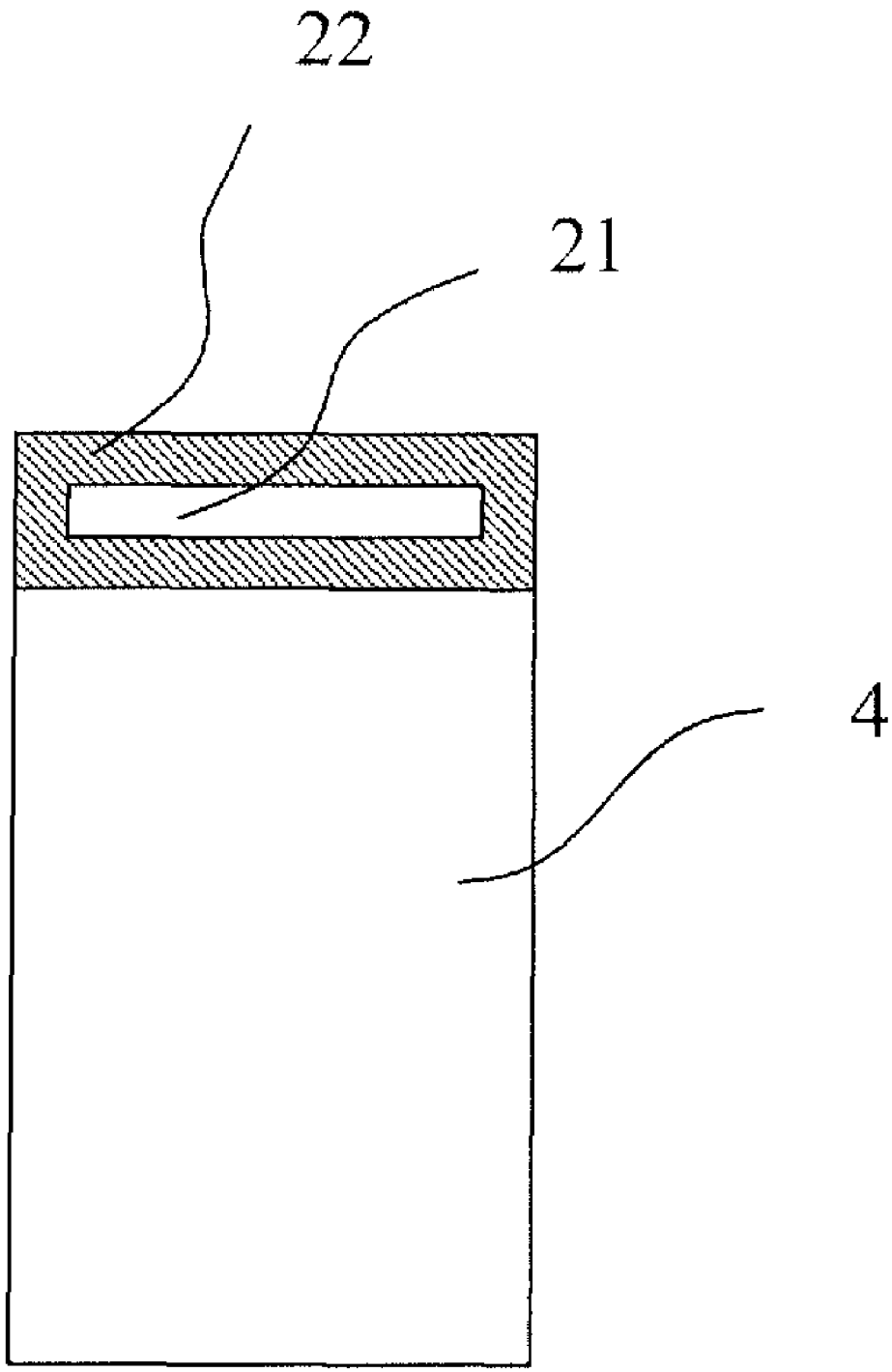
FIG. 8 is a schematic top view of the perforated plate including a sketch of the outlet opening of the supply container and the product inlet surface of the perforated plate.

The general boundary conditions are that the device should occupy the smallest possible amount of space and have the highest possible output at the same time. A contribution toward achieving both of these objects is provided in that the outlet opening 21 of the product outlet 2 comprises a basic shape oriented around a rectangle with a width approximately the same as that of the perforated plate 4 and a length, i.e., a dimension in the transport direction of the individual products, adapted to the size of the individual products. The perforated plate 4 comprises, underneath the product outlet 2, a hole-free product inlet surface 22 (see FIG. 3) corresponding to the length of the outlet opening 21. It is therefore provided in the device that as much of the width of the perforated plate 4 as possible is used for product distribution when the individual products are deposited onto the perforated plate 4, which means that outlet opening 21 of the product outlet 2 is adapted to this requirement. Choosing an appropriate shape for the outlet opening 21, namely, a skinny rectangle, makes it possible to reduce the length of the hole-free area of the perforated plate 4, that is, the length of the product inlet surface 22, and therefore to minimize the area which does not contribute to breakage separation. When the individual products are delivered through a small round outlet opening according to the prior art, they must travel a longer distance in the transport direction before they can spread out evenly from the edges of the product outlet 21 to the edges of the perforated plate 4, whereas, when the products are delivered through the rectangular opening (FIG. 8), they become evenly distributed from edge to edge after traveling a much shorter distance. It has been found favorable for the outlet opening 21 to be rectangular in design with a width equal to 60-95%, preferably 75-85%, of the width of the perforated plate 4 and with a length corresponding to 2-12 times, especially 5-8 times, the size of the products, wherein the product inlet surface 22 comprises 3-8 times the size of the outlet opening 21.

Figure 9:
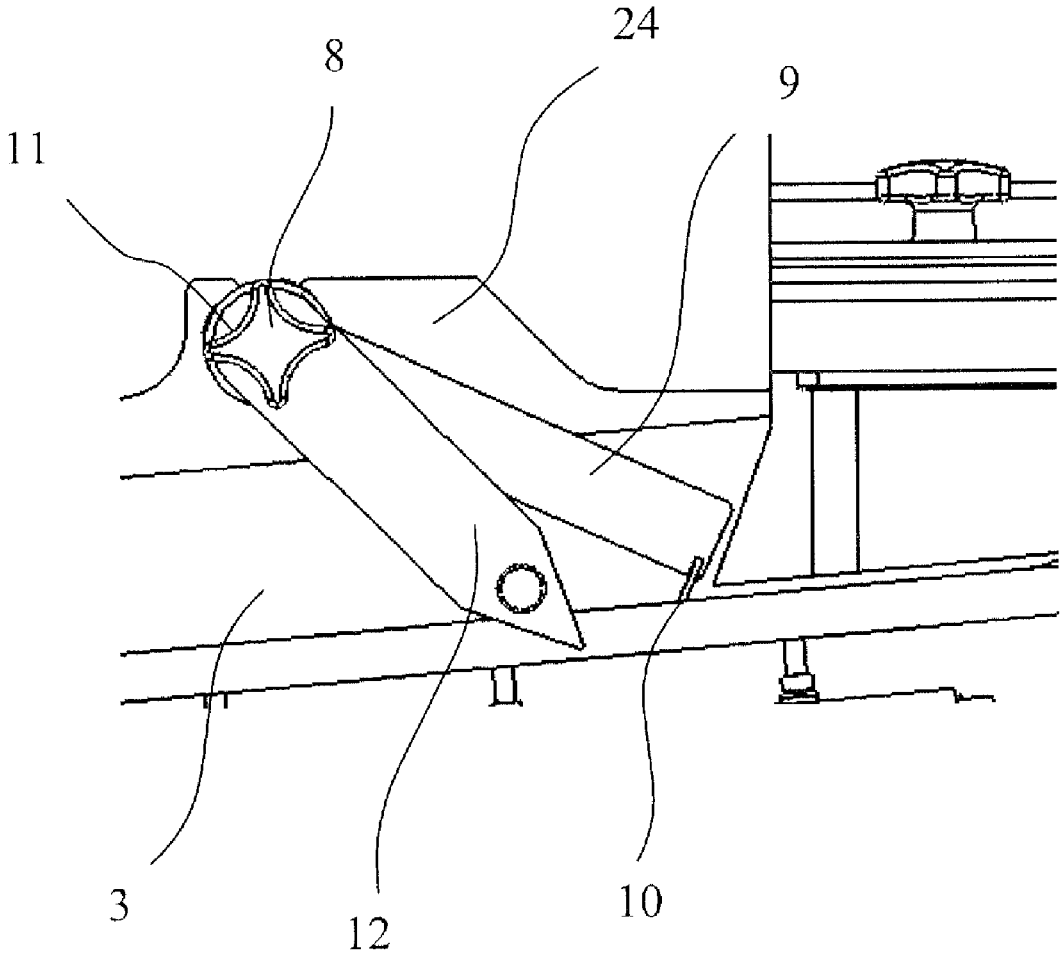
FIG. 9 is a side view of the plate holder with a bulk material leveler in a first rotational position.
Figure 10:
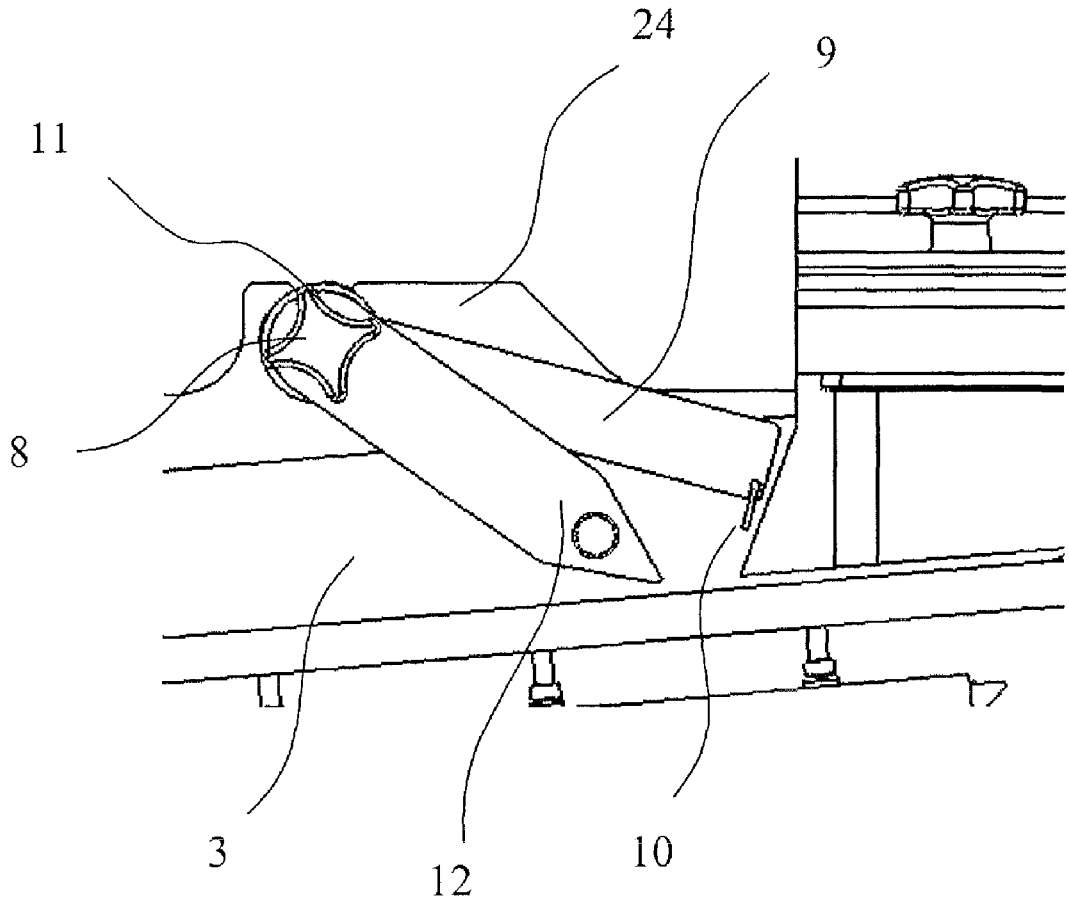
FIG. 10 is a view corresponding to FIG. 9 with the bulk material leveler in a second rotational position.

When the individual products are transferred from the supply container 1 to the transfer unit, it is important for the individual products to form a layer on the perforated plate 4 which is only one deep. Therefore, downstream from the product outlet 2, above the perforated plate 4, a bulk material leveler 9 formed as a leveler strip is mounted rotatably on a pivot axis 8 (FIG. 9). So that the perforated plates 4 located underneath the bulk material leveler 9 can be replaced, the leveler is connected detachably to the base stand 24. The bulk material leveler 9 comprises an elastic lip 10 on its free end facing the perforated plate 4 to ensure that the individual products are treated gently. The rotational position of the bulk material leveler 9 can be set by means of a positioning element 11, preferably a clamping screw with a T-handle, so that the bulk material leveler 9 can be adjusted to suit the size of the individual products (FIG. 10). An adjusting lever 12 is provided on the clamping screw itself.

Figure 11:
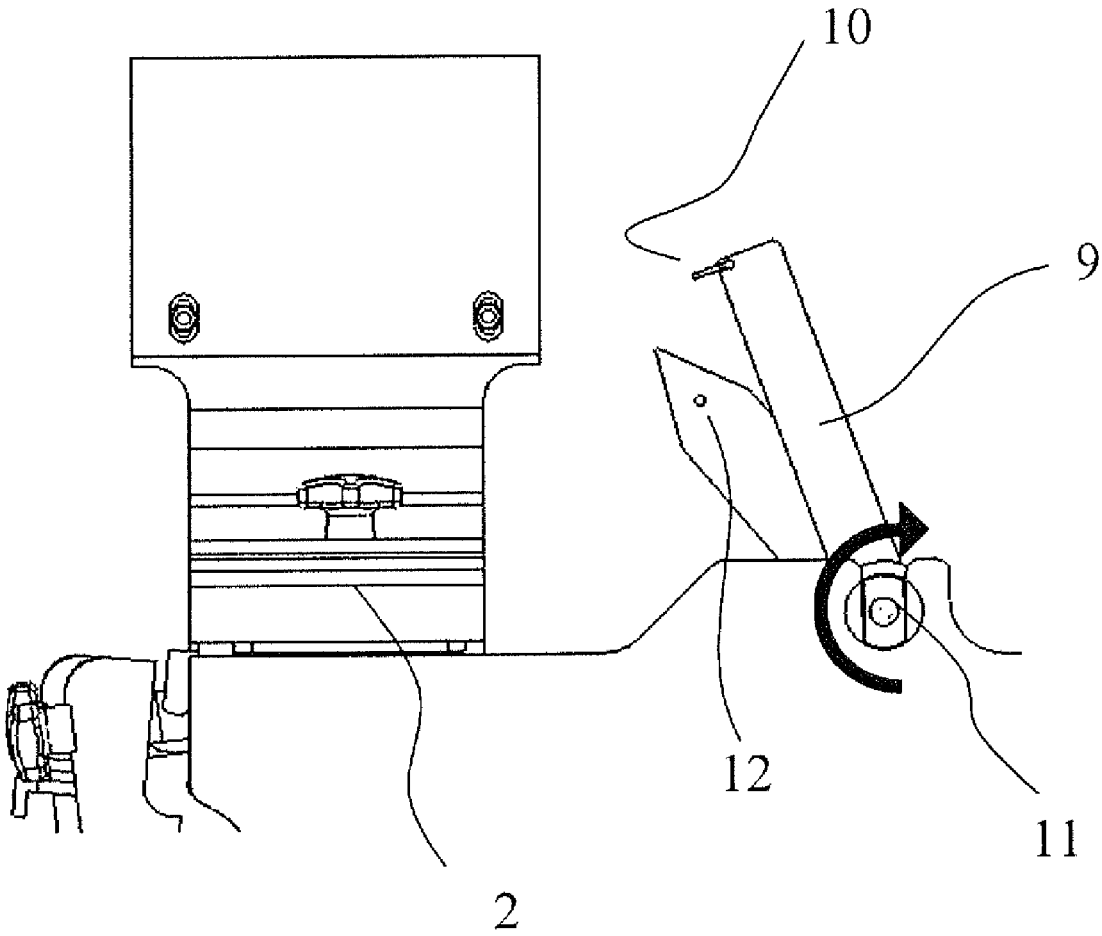
FIG. 11 is a view of the preparation for the removal of the bulk material leveler.
Figure 12:
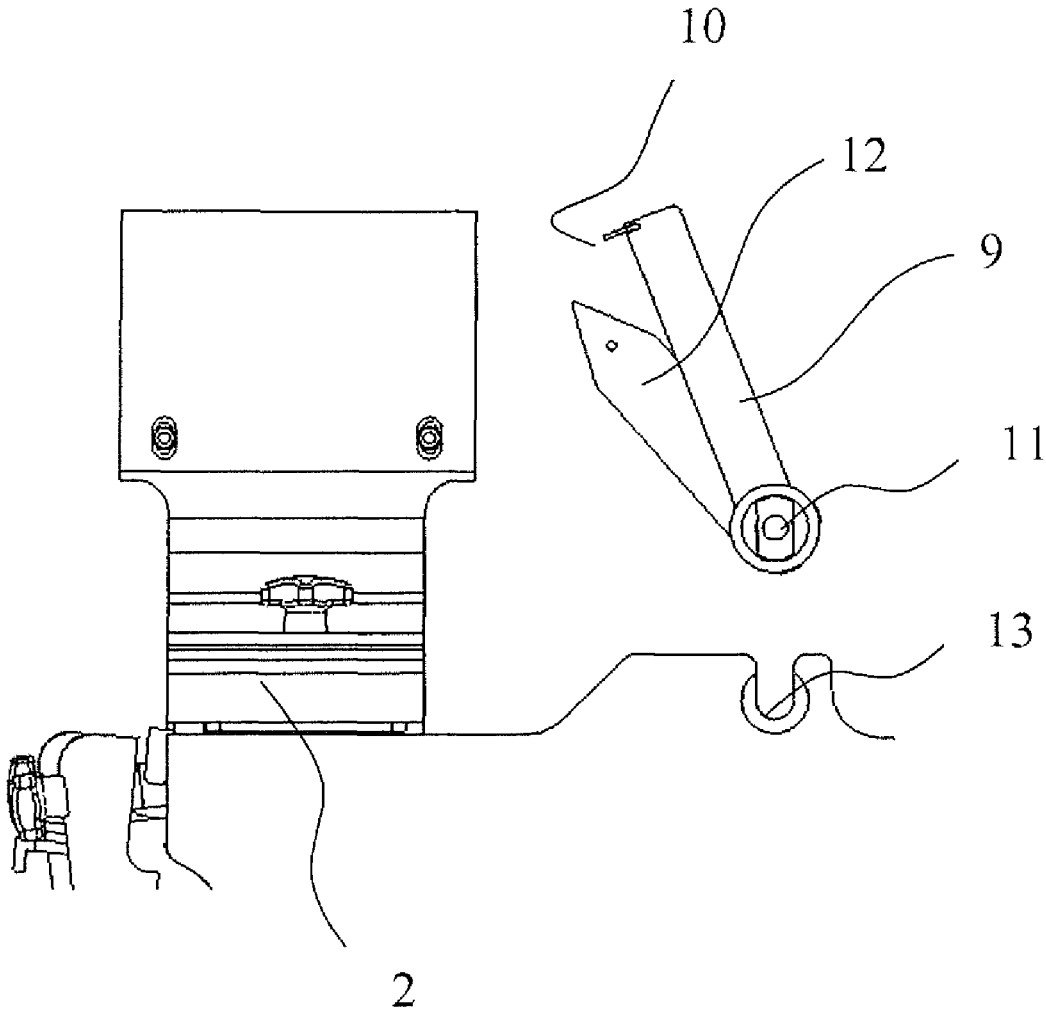
FIG. 12 is a view corresponding to FIG. 11 after the bulk material leveler has been removed from the plate holder.

When the type of the individual products to be packaged in the pockets of the web of sheeting is to be changed, it is also necessary to replace the old perforated plate with a new one with holes adapted to the size and shape of the new individual products, so that, to achieve the shortest possible setup time for the device, it should be possible to accomplish such a change easily, quickly, and by a single person if at all possible. To replace the perforated plates 4, therefore, first the clamping screw is loosened, and then the adjusting lever 12 is used to rotate the bulk material leveler 9 (FIG. 11) in such a way that it can be removed by pulling it upward out of its screw receiving groove 13 (FIG. 12), which is open in the upward direction.

Figure 5:
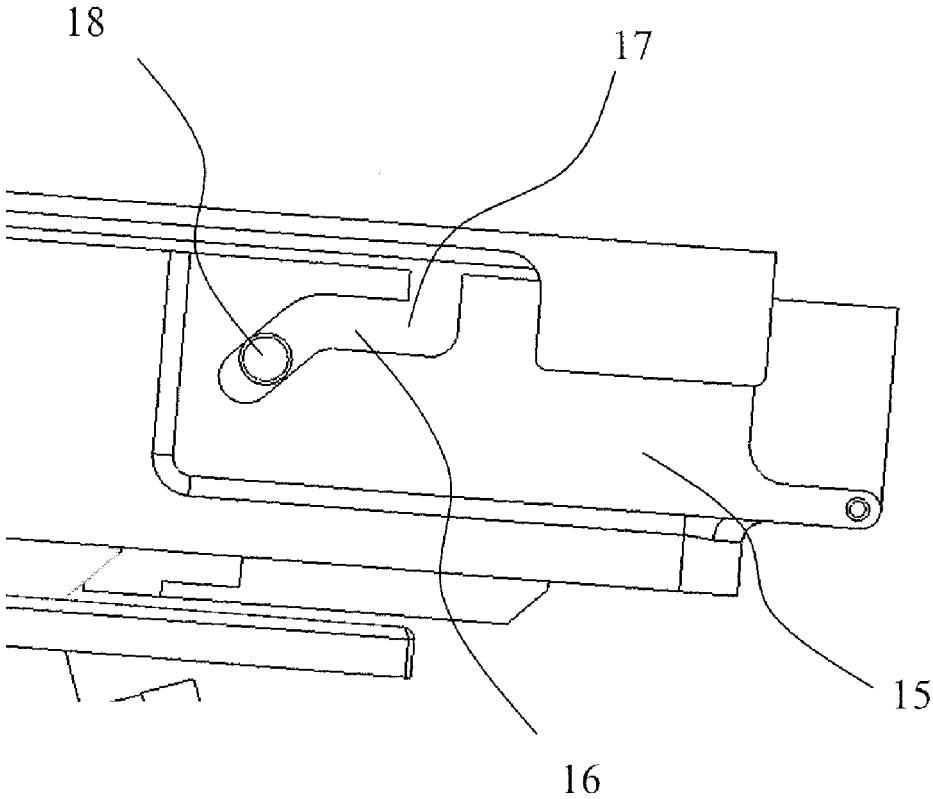
FIG. 5 is an enlarged side view of the detail marked "V" in FIG. 3.
Figure 6A:
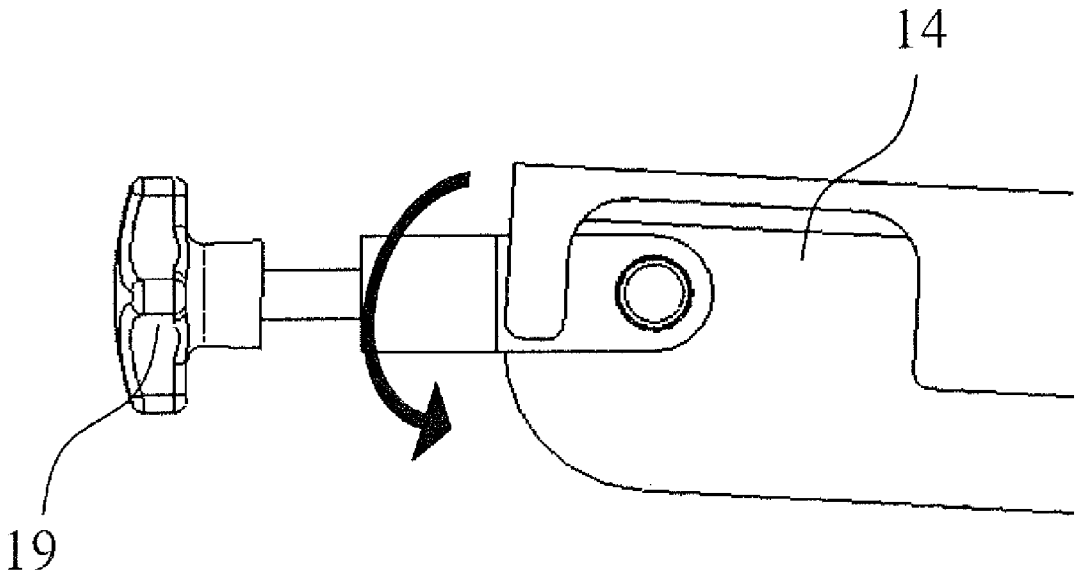
FIGS. 6*a*-6*c* are three side views showing the separation of the clamping screw from the clamping strip.
Figure 6B:
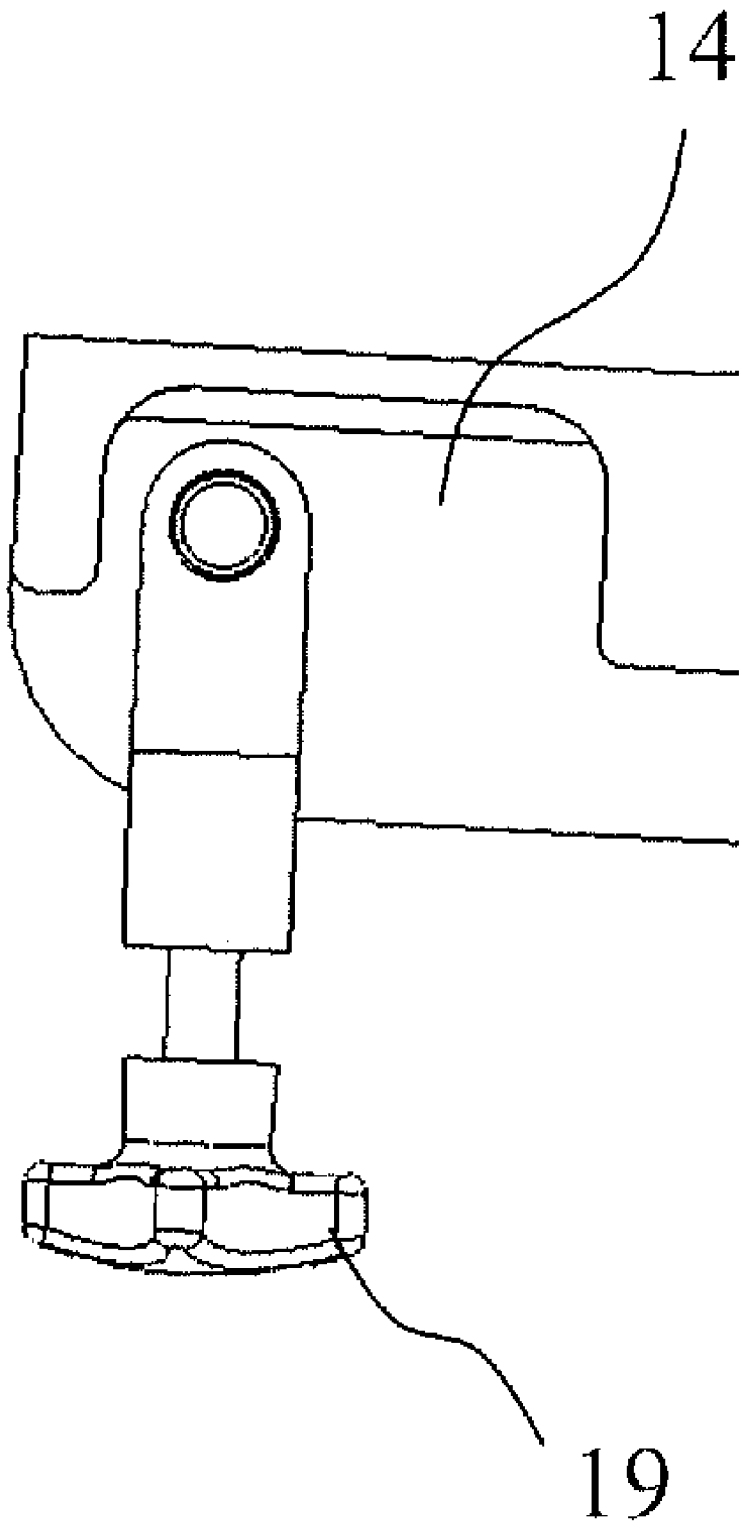
Figure 6C:
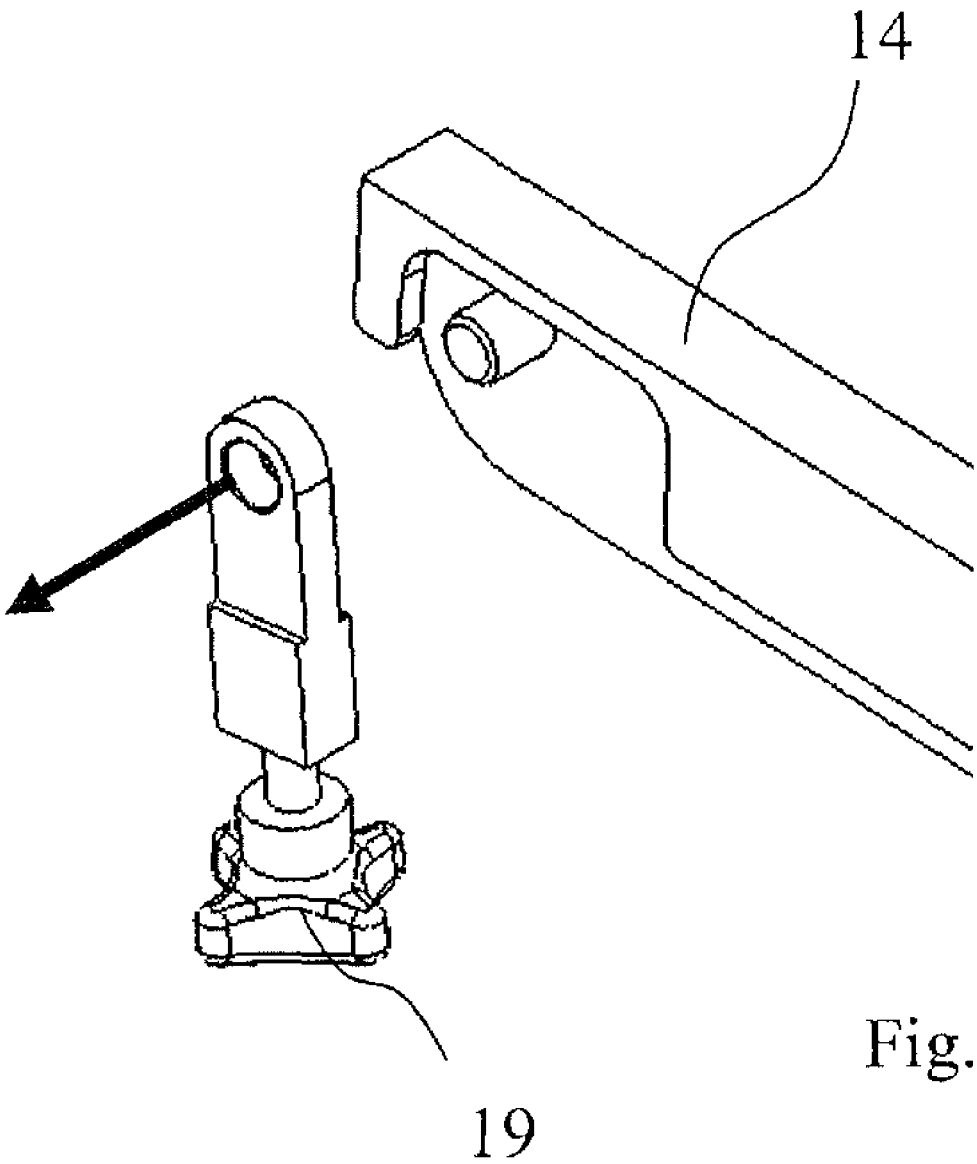

The reason that the perforated plates 4 can be replaced easily is that the plate holders 3 on which the clamping strips 14 are arranged are designed as motion guideway carriers 15 (FIG. 5). Each clamping strip 14 is supported in a motion guideway 16 of the motion guideway carrier 15. The motion guideway 16 extends at an angle to the vertical and is formed as a guide slot 17, which is open at one end and into which the guide pin 18 of the clamping strip 14 can thus be inserted. At the end of the clamping strip 14 near the product inlet surface 22, a clamping means, preferably a clamping screw 19, is provided, which engages in a screw block 23, which extends downward at an angle to the vertical. The angle of the motion guideway 16 may preferably correspond to the angle of the clamping screw 19, so that, when the clamping screws 19 are turned in the clamping direction, the clamping strip 14 as a whole is pulled downward at this same angle and the perforated plate 4 is thus clamped to the plate holder 3 and thus the base stand 24. To make it even easier to clean the device, the clamping screw 19 may be connected detachably to the clamping strip 14 (FIGS. 6*a*-6*c*). However, apart from the preferred embodiment described above, a number of other clamping means for fixing the clamping strip 14 may be used as long as they provide proper and even clamping of the clamping strip 14 onto the perforated plate 4.

Figure 3:
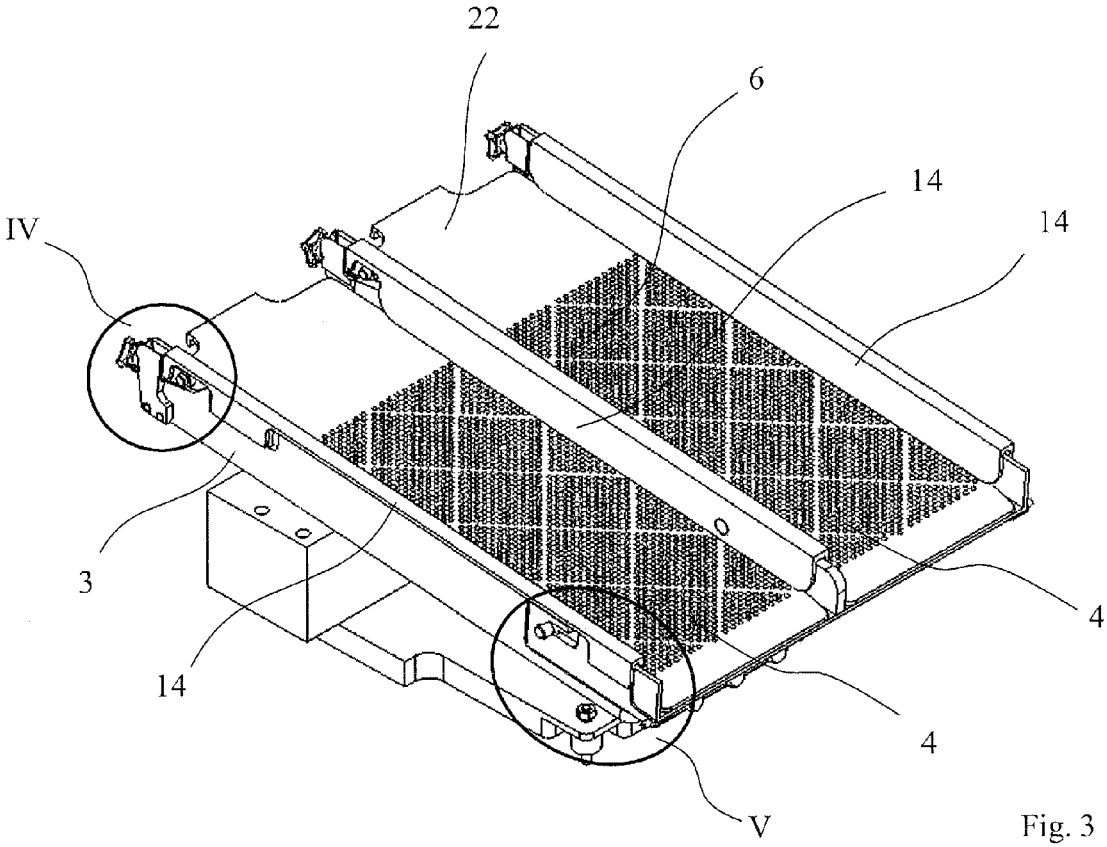
FIG. 3 is a perspective view of an isolated plate holder of a base stand with associated perforated plates and clamping strips.
Figure 4:
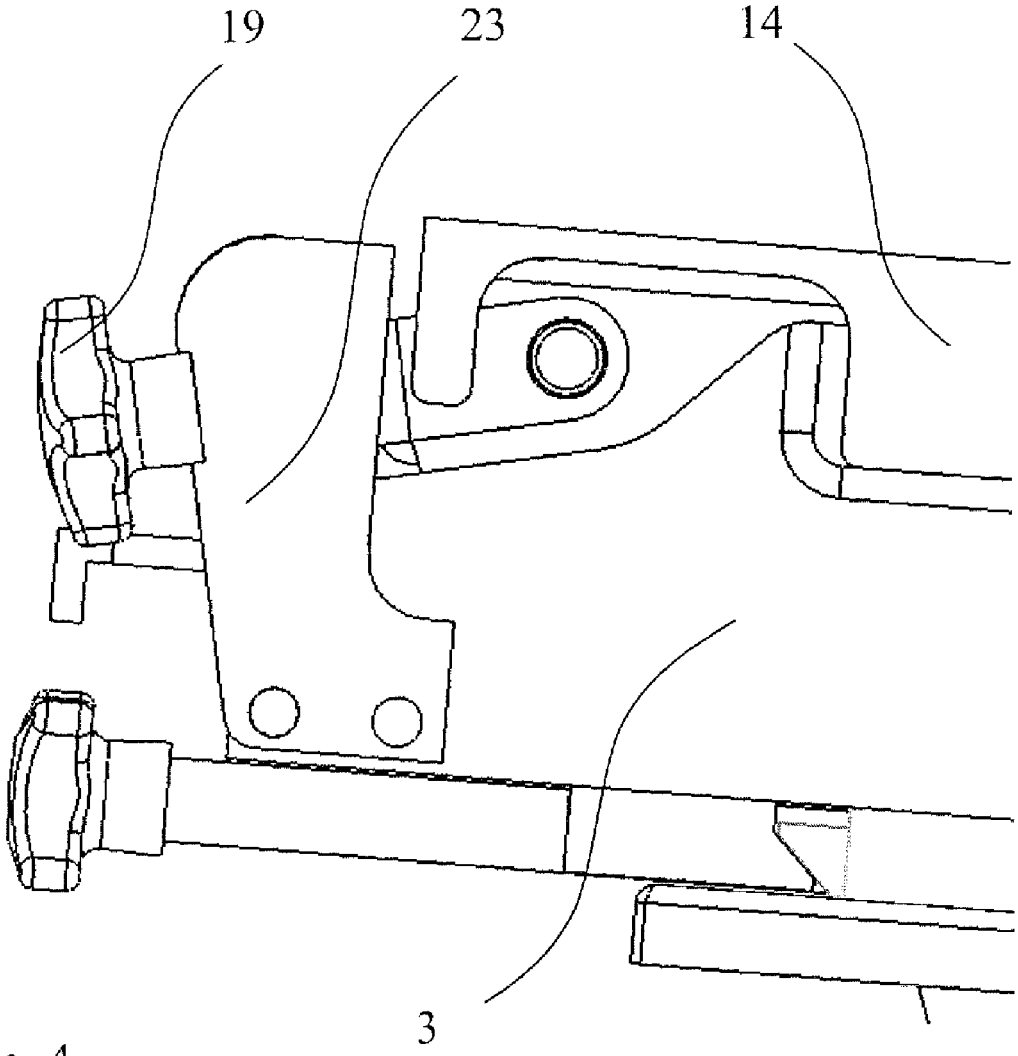
FIG. 4 is an enlarged side view of the detail marked "IV" in FIG. 3.

FIGS. 1-3 show that several clamping strips 14 are provided in an arrangement assigned to the lateral edges of the perforated plates 4. Because, in the case of the exemplary embodiment shown here, two perforated plates 4 are present, located one next to the other, the middle clamping strip 14 serves to act on two lateral edges, namely, on one of the edges of the perforated plate 4 on the left and on one of the edges of the perforated plate 4 on the right. The presence of the middle clamping strip 14 also means that an opening 20 must be provided in the bulk material leveler 9. After the leveler has been removed, the clamping screws 19 can be loosened and the clamping strips 14 pushed along the motion guideway 16, so that the guide pin 18 can be removed via the open end of the guide slot 17. The clamping strip 14 can now be removed from the plate holder 3. The perforated plates 4 are thus freely accessible and can be removed and replaced by new perforated plates 4, for which purpose it is necessary merely to reinsert the guide pins 18 of the previously cleaned clamping strips 14 into the guide slots 17 and to pivot the clamping strips 14 onto the perforated plates so that they can be clamped down again by means of the clamping screws 19.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for delivering bulk material consisting of individual products, the device comprising:

a supply container for storing the bulk material of individual products, the supply container having a product outlet;

at least one perforated plate arranged downstream of the product outlet of the supply container on a base stand, the at least one perforated plate serving to receive the individual products from the product outlet and to move them further in a transport direction while removing broken products and dust; and a bulk material leveler formed as a leveler strip rotatable around a pivot axis, the bulk material leveler being arranged downstream of the product outlet above the perforated plate, wherein an elastic lip is arranged on a free end of the bulk material leveler facing the perforated plate;

and wherein the bulk material leveler is detachably connected to the base stand.

2. A device for delivering bulk material consisting of individual products, the device comprising:

a supply container for storing the bulk material of individual products, the supply container having a product outlet;

at least one perforated plate arranged downstream of the product outlet of the supply container on a base stand, the at least one perforated plate serving to receive the individual products from the product outlet and to move them further in a transport direction while removing broken products and dust;

a bulk material leveler formed as a leveler strip rotatable around a pivot axis, the bulk material leveler being arranged downstream of the product outlet above the perforated plate; and a positioning element for adjusting and maintaining a rotational position of the bulk material leveler.

3. The device according to claim 2, wherein an elastic lip is arranged on a free end of the bulk material leveler facing the perforated plate.

4. The device according to claim 2, wherein the positioning element is formed by a clamping screw with a T-handle inserted into a screw receiving groove open in an upward direction.

5. The device according to claim 4, wherein an adjusting lever is arranged on the clamping screw.

6. The device according to claim 2, wherein the bulk material leveler is detachably connected to the base stand.

7. The device according to claim 1, further comprising a positioning element for adjusting and maintaining a rotational position of the bulk material leveler.

8. The device according to claim 7, wherein the positioning element is formed by a clamping screw with a T-handle inserted into a screw receiving groove open in an upward direction.

9. The device according to claim 8, wherein an adjusting lever is arranged on the clamping screw.

* * * * *